US007533430B2

(12) United States Patent
Moxey

(10) Patent No.: US 7,533,430 B2
(45) Date of Patent: May 19, 2009

(54) PEG TOOL

(76) Inventor: Norman Moxey, PO Box 7172, Urangan Qld 4655 (AU)

( * ) Notice: Subject to any disclaimer, the term of this patent is extended or adjusted under 35 U.S.C. 154(b) by 0 days.

(21) Appl. No.: 10/570,380

(22) Filed: Mar. 1, 2006

(65) Prior Publication Data

US 2006/0266165 A1 Nov. 30, 2006

Related U.S. Application Data

(63) Continuation-in-part of application No. PCT/AU2004/001179, filed on Aug. 31, 2004.

(30) Foreign Application Priority Data

Sep. 1, 2003 (AU) ..... 2003904815

(51) Int. Cl.
*B25D 1/04* (2006.01)
*B25C 11/00* (2006.01)
*B66F 3/00* (2006.01)

(52) U.S. Cl. ..... 7/143; 254/131

(58) Field of Classification Search ..... 7/143–147, 7/169; 81/25; 254/113, 114, 131, 132, 18–28
See application file for complete search history.

(56) References Cited

U.S. PATENT DOCUMENTS 840,580 A * 1/1907 McMillan ..... 7/144
6,634,047 B2 * 10/2003 Rowland ..... 7/143
6,862,765 B2 * 3/2005 Liou ..... 7/143
6,948,700 B2 * 9/2005 Wood ..... 254/25
7,159,260 B2 * 1/2007 Hansen ..... 7/143
2001/0032366 A1 10/2001 Rowland

FOREIGN PATENT DOCUMENTS

AU B-35573/93 5/1994
AU 199863519 11/1998
AU 2002100651 A4 12/2002

* cited by examiner

*Primary Examiner*—Hadi Shakeri
(74) *Attorney, Agent, or Firm*—TraskBritt, P.C.

(57) ABSTRACT

A tool for inserting and withdrawing a peg in the ground comprises a body (20, 60, 101) having an internal space (22, 61, 110), and a peg puller which includes a peg engaging means (30, 74, 120) for engagement with a peg in the ground. An impact member (26*a*, 71, 123) is located within and is movable within the internal space in the body. A hammer head (10*a*, 51, 105) is provided at one end of the body. The body further includes a strike area (25, 65, 128) within the internal space and located so that the impact member strikes against the strike area at one limit of movement thereof inside the internal space. The peg puller further includes a connecting portion (36, 73, 121) extending from the impact member to the peg engaging means so that when the impact member strikes against the strike area, a shock load is transferred through the connecting portion to the peg engaging means to thereby apply a pulling force to the peg.

16 Claims, 11 Drawing Sheets

PEG TOOL

RELATED APPLICATION

This application is a continuation-in-part of International Application Number PCT/AU2004/001179, filed 31 Aug. 2004. This application claims foreign priority under 35 U.S.C. §119 based on International Application Number PCT/AU2004/001179, filed 31 Aug. 2004, based on Australian Patent Application No. 2003904815, filed 1 Sep. 2003.

FIELD OF INVENTION

This invention relates to a tool for manipulation of a peg in a substrate such as the ground. More particularly, this invention relates to a peg extraction tool.

BACKGROUND ART

The following references to and descriptions of prior proposals or products are not intended to be, and are not to be construed as, statements or admissions of common general knowledge in the art in Australia.

Typically, prior peg removing tools rely on leverage principles. They can be difficult to use, particularly in hard ground, and may be ineffective to extract the peg without considerable effort. Accordingly, conventional hammering (shock load) techniques have been employed in devices to break up the frictional forces binding a peg in the ground.

In U.S. Pat. No. 4,454,792 (Burris) a bar stake puller using the sliding hammer principle is disclosed. The bar stake puller is a hand tool comprising a claw foot 1 having a standing bar 2 and a sliding bar 3 with a handle 10, wherein the standing bar and the sliding bar are adjacently engaged to each other whereby to slide relative to one another along parallel, non-coaxial axis. Because the standing and sliding bars are not coaxial, torque about the longitudinal axes of the standing bar 2 and the sliding bar 3 occurs during use (see column 2, lines 30 to 33). Moreover, because the sliding bar 2 makes up less than half of the total mass of the pulling tool, and being lightweight, it is ineffective in its application of the sliding hammer principle. Burris describes the likelihood of personal injury particularly to hands, fingers or flesh when using tools that involve the sliding hammer principle. Burris claims to remove this risk by reducing the mass of the moving part and providing for one-handed operation. Used properly, Burris' tool may not cause injury. However, the meeting of the two surfaces that create the impact function of this tool occur external to the body of the tool and are thus easily accessible to the operator's hands/body.

In U.S. Pat. No. 4,261,424 (Gonterman et al) there is described a peg driver and extractor adapted for a peculiarly designed peg head (see FIG. 4). The Gonterman tool includes a reciprocating member 16 coaxially mounted on a tubular member 11. The reciprocating member 16 is presumably grasped by the operator and used as a sliding hammer when the tool 10 is engaged to a specifically designed peg. The momentum, and ultimately the shock load, is particularly restricted by the relatively low mass of the reciprocating member 16 as a proportion of the total mass of the tool. The use of the Gonterman tool is limited by the peg driving method which also makes use of slide hammer principles. This tool would probably require a second person to hold the tent peg steady during the first stages of the driving in process since the tool itself requires two hands to operate. Moreover, the strike plates 19 against which tubular member 16 impacts are exposed whereby the user may jam his fingers between member 16 and plate 19.

There is a need for a tool which overcomes the shortcomings of the above described prior art or at least provides a useful alternative thereto.

STATEMENT OF INVENTION

Accordingly, the invention provides in one aspect a tool for manipulation of a peg in a substrate, said tool comprising:

an elongate first component having at an end thereof means for engaging a peg in a substrate and applying a withdrawing force thereto;

a second component slidable along the first component from a first position to a second position where opposing striking surfaces of the first and second components impact with each other so that an impulsive said withdrawing force is transmitted by the first component to the peg, the tool characterised in that the second component comprises a hammer head portion adapted for hammering pegs into a substrate.

Preferably a substantial proportion of the mass of the tool is concentrated in the hammer head portion of the second component. For example, at least 60%, and preferably up to 90% of the total mass of the tool may be comprised in the hammer head portion of the second component.

In the preferred embodiment the second component further comprises an elongate handle portion adapted to be gripped by a user when hammering pegs into a substrate using the second component as a hammer or mallet. That is, the tool can be used in the manner of a conventional hammer for driving pegs into a substrate such as the ground, but can also ease the withdrawal of pegs from the substrate.

Desirably, a portion of the first component having the striking surface is received in an internal space of the handle portion and slideable therein in a longitudinal direction of the handle portion. This arrangement is preferable inasmuch as the risk of harm to users from parts moving relative to each other when withdrawing pegs is reduced.

It is preferred that the first component extends through an opening in the handle portion and a formation comprised in the first component is proportioned to be unable to pass through the opening so that a part of the first component comprising the formation is retained in the internal space in use of the tool for withdrawing a peg from a substrate.

However, in one embodiment, a part of the handle portion is movable or removable to a position permitting separation of the first component from the second component. To this end, the part of the handle portion may conveniently be hinged to a remaining part of the handle portion and partly define a boundary of the opening.

Particularly where the first and second components are to remain together at all times, the tool may comprise resilient means (preferably a spring) arranged to urge the second component towards the first position. In another arrangement, a formation of that part of the first component outside the handle portion is receivable and frictionally retainable in a cooperating recess of the handle portion so as to hold the first component in a position of maximum engagement with the handle portion. The formation receivable in the recess may be comprised in a hook formed at an end of the first component.

Preferably, the internal space and that part of the first component slideable therein are so shaped that the first component approximately aligns with the longitudinal direction of the handle portion.

In one embodiment, the handle comprises a tube having an internal surface which guides the first component for sliding movement therein. A guide formation of the first component may extend laterally into a longitudinal slot in the tube so that the first component is substantially prevented from rotating in the tube.

In this embodiment, preferably:

(a) the hammer head portion is spaced apart from the handle portion and secured thereto by bridging means;

(b) space for a user's fingers is provided between at least a part of the hammer head portion and the handle portion so that when using the tool to withdraw a peg from a substrate a user can grip the hammer head portion and thereby apply a pulling force to the second component that is transmitted to the first component.

In another embodiment, the hammer head portion comprises a massive part;

an elongate tension member is secured to the massive part and received in the internal space of the handle portion; and the striking surface of the second component is comprised in the tension member.

It is particularly preferred that (a) the tension member comprises two elongate arms that:

(i) are secured to the massive part;

(ii) are transversely spaced apart in the internal space and connected to each other by joining means at an end of the tension member remote from the massive part, and (b) the striking surface of the second component is comprised in the joining means.

Advantageously, within the massive part the elongate arms are urged apart from each other and against internal surfaces of the massive part by a retainer component received in an opening in the massive part and between the arms so that the arms are tightly secured within the massive part. The retainer component may comprise a pin force-fitted in the opening in the massive part.

The internal space of the handle portion is preferably defined by an external casing of the handle portion.

More preferably, the massive part of the hammer head portion is close fittingly and at least partially enclosed within an external casing of the hammer head portion and wherein the hammer head portion and handle portion external casings are integrally formed with each other.

The external casing may be formed of a plastics or synthetic rubber-like material. This can give an attractive appearance and feel, and allow shaping of the handle portion for safe and effective gripping.

Where the tension member comprises two arms, a formation of the first component comprising the striking surface of the first component may be slidingly received between the arms. The part of the first component within the handle portion may comprise a rod having an end which is bent back upon itself to form the formation that comprises the striking surface of the first component.

For all the embodiments, it is preferred that the means for engaging a peg in a substrate comprises a hook formed on the first component.

Preferably, the first component further comprises peg head retaining means for retaining a head of the peg in a crook of the hook. For safety and convenience, resiliently deformable means operative to deform to permit entry of the peg head in the crook may be provided.

In a further aspect, the invention provides a method for assembly of a tool for manipulation of a peg in a substrate, comprising the steps of:

(a) providing a massive part adapted to act as a peg striking part of a hammer head portion of a hammer;

(b) securing to the massive part a tension member having a striking surface at a position thereon remote from the massive component;

(c) mounting in operative association with the tension member for sliding therealong a further component having at an end thereof means for engaging a peg in a substrate and applying a withdrawing force thereto, the further component having a striking surface thereon positioned to impact with the striking surface of the tension member when the assembly comprising the massive part and the tension member is slid to a first position along the further component.

Preferably, the method includes the step of partially encasing the massive part and the tension member in a close-fitting external casing. This may be conveniently done by moulding the casing around the massive part and then entering the tension member into the handle portion of the casing and securing it in the massive part.

The first component may be configured to be light in weight compared to the handle member by forming it at least in part from a shaft or rod. The shaft may be a thin rod made of strong, but relatively light material, such as a suitable aluminium alloy or steel. It will be appreciated that any solid metal shaft should be sufficiently strong (in terms of tensile and torsional strength), rigid and capable of resisting metal fatigue as a result of use over a long period. Moreover, provided hollow tubing is sufficiently strong it should be suitable.

In another aspect of the invention, there is provided a tool for manipulation of a peg in a substrate, the tool comprising:

a body having an internal space, and a peg puller which includes a peg engaging means for operative engagement with a peg in a substrate and an impact member located within and relatively movable within the internal space in the body, the body further including a strike area located within the internal space and located so that the impact member strikes against the strike area at one limit of movement thereof inside the internal space, the peg puller further including a connecting portion extending from the impact member to the peg engaging means so that when the impact member strikes against the strike area, a shock load is transferred through the connecting portion to the peg engaging means to thereby apply a pulling force to the peg when engaged by the peg engaging means.

Preferably the impact member is captured inside the internal space and is movable linearly within the internal space relatively towards and away from the strike area. The body may comprise an elongated tube and the internal space may comprise an elongated internal bore of the tube, the impact member being comprised by an enlarged head linearly movable within the tubular bore and the strike area being located at one end of the tubular bore. In this embodiment, the strike area may have an opening through which the connecting portion of the peg puller extends from the impact member which is captive inside the bore of the tube to the peg engaging means.

The body may comprise a massive part, a tubular body portion having an elongated bore therein which defines the internal space, an elongate tension member secured to the massive part and being received in the bore, the strike area being provided by the tension member spaced from the massive part. The tension member may comprise two elongate arms that are secured to the massive part and which extend along and are spaced apart within the bore and which are connected to each other by a joining means at the end of the tension member remote from the massive part, and the strike area may be comprised by the joining means. In this embodiment, the impact member is preferably slidingly received within the bore between the elongate arms of the tension member.

The connecting portion of the peg puller may comprise an elongate rod and the impact member may comprise an end portion of the elongate rod which is bent back upon itself so as to be located between the elongate arms of the tension member and to be slidingly movable longitudinally along the elongate arms, whereby at one limit of travel of the impact member, the bent end portion of the connecting rod comprising the impact member strikes against the strike area comprised by the joining means between the two elongate arms of the tension member.

In yet another aspect of the invention, there is provided a tool for manipulating a peg in a substrate, the tool comprising:

a body having a strike area, and a peg puller comprising a peg engaging means for operative coupling to a peg in a substrate, an impact member movable linearly relative to the body so as to selectively move the impact member away from and towards and into contact with the strike area of the body so that the impact member strikes against the strike area of the body at one limit of movement thereof, and a connecting portion extending from the impact member to the peg engaging means so that when the impact member strikes against the strike area of the body, a shock load applies a pulling force through the connecting portion to the peg engaging means and thence to the peg in the substrate, wherein the tool further includes an internal space providing by either the body or the peg puller, and wherein both the impact member of the peg puller and the strike area of the body are located internally within the internal space with one of the impact member and the strike area being provided by an internal formation of the internal space and the other of the impact member and the strike area being provided by a captured formation relatively movable within the internal space.

In this embodiment, the impact member is preferably captured inside the internal space and is movable linearly within the internal space relatively towards and away from the strike area. Preferably the body comprises an elongated tube and the internal space comprises an elongated internal bore of the tube, the impact member being comprised by an enlarged head linearly movable within the tubular bore and the strike area being located at one end of the tubular bore. The strike area may have an opening through which the connecting portion of the peg puller extends from the impact member which is captive inside the bore of the tube to the peg engaging means.

As in the earlier summarised embodiment, the body may comprise a massive part, a tubular body portion having an elongated bore therein which defines the internal space, an elongate tension member secured to the massive part and being received in the bore, and the strike area being provided by the tension member spaced from the massive part. The tension member may comprise two elongate arms that are secured to the massive part and which extend along and are spaced apart within the bore and which are connected to each other by a joining means at the end of the tension member remote from the massive part, and the strike area may be comprised by the joining means. The impact member is preferably slidingly received within the bore between the elongate arms of the tension member. The connecting portion of the peg puller preferably comprises an elongate rod and the impact member preferably comprises an end portion of the elongate rod which is bent back upon itself so as to be located between the elongate arms of the tension member and to be slidingly movable longitudinally along the elongate arms, whereby at one limit of travel of the impact member, the bent end portion of the connecting rod comprising the impact member strikes against the strike area comprised by the joining means between the two elongate arms of the tension member.

In another aspect of the invention, there is provided a method of extracting a peg embedded in the ground comprising:

(a) providing a peg extracting tool which comprises:

a body having a strike area, and a peg puller comprising a peg engaging means for operative coupling to a peg in a substrate, an impact member movable linearly relative to the body so as to selectively move the impact member away from and towards and into contact with the strike area of the body so that the impact member strikes against the strike area of the body at one limit of movement thereof, and a connecting portion extending from the impact member to the peg engaging means so that when the impact member strikes against the strike area of the body, a shock load applies a pulling force through the connecting portion to the peg engaging means and thence to the peg in the substrate, the tool further including an internal space providing by either the body or the leg puller, and wherein both the impact member of the peg puller and the strike area of the body are located internally within the internal space with one of the impact member and strike area being provided by an internal formation of the internal space and the other of the impact member and strike area being provided by a captured formation relatively movable within the internal space;

(b) coupling the peg engaging means to the peg embedded in the ground; and (c) with the body in a start position located closer to the peg, sharply pulling the body away from the peg and away from its start position so that the captured formation and the internal formation of the tool move relatively towards each other until the relative movement causes the impact member to strike against the strike area thereby creating a shock load applying a pulling force through the connecting portion and through the peg engaging means to the peg embedded in the ground.

The method may also comprise the further subsequent steps of:

(d) moving the body towards the peg so as to separate the impact member from the strike area within the internal space; and (e) repeating step (c) of sharply pulling the body away from the peg to repeat the creation of the shock load applying a pulling force to the peg and, if necessary, repeating steps (d) and (e) sufficient times until the peg is no longer embedded in the ground.

The pegs with which tools of the invention can be used may be any one of a range of standard peg types suitable for anchoring items such as ropes, guide ropes, wires, tension wires and the like to the ground. The peg for which the tool is useable may include a projection or recess or other formation with which the peg engaging means may cooperate to achieve a positive engagement. However, the peg engaging means may include clamp means to frictionally engage the peg where the peg has no surface or engagement features with which to positively engage. The peg for example may consist of a simple bent rod forming at its top end a hook, which is a common type of tent peg in current use and which is adapted to sit proud of, or visible above, the ground.

BRIEF DESCRIPTION OF THE DRAWINGS

The invention may be better understood from the following non-limiting description of one or more preferred embodiments, in which:

FIG. 21 comprises rear, top and sectional views (marked (a), (b) and (c) respectively) of a further component of the fifth embodiment, the cross-section (c) being taken at the station marked "CC" in FIG. 21(*a*);

DETAILED DESCRIPTION OF THE DRAWINGS

Figure 1:
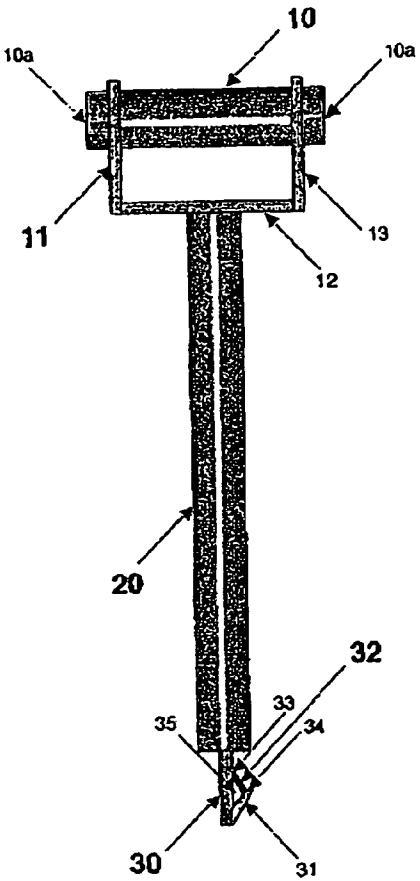
FIG. 1 is a front view of a tool according to a first embodiment.
Figure 3:
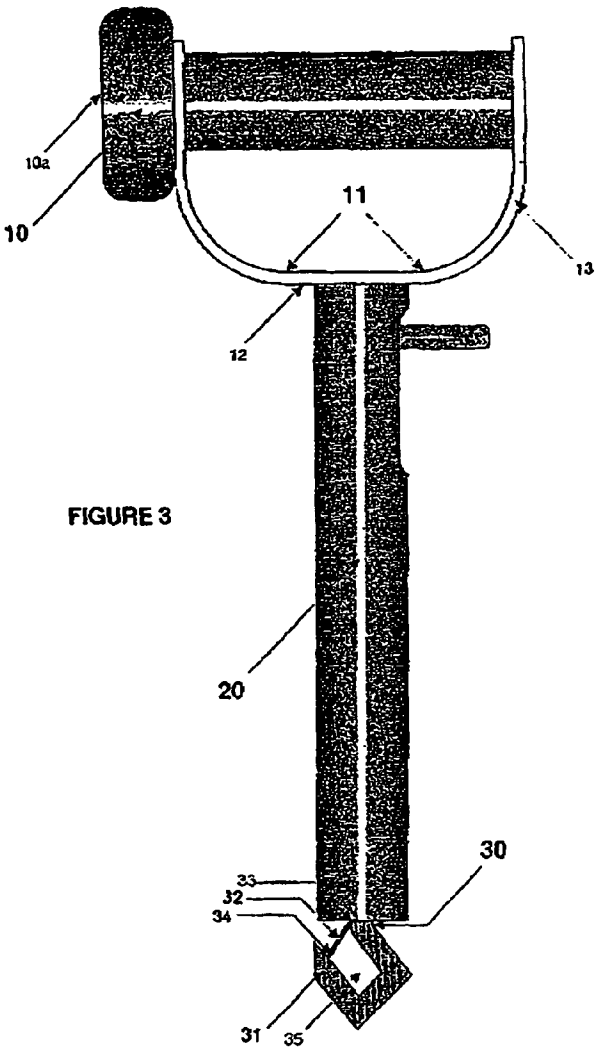
FIG. 3 is a front view of a tool according to a second embodiment.

Referring firstly to FIGS. 1 and 3, there is shown a peg driving and extraction tool 1 including a second component 10, 20 having a hammer head/handle 10, a body/handle 20, and an elongate first component 30 shown as an operating rod. Like components are referred to using like reference numerals. The first component 30 acts as a peg puller.

The hammer head 10 may be made of a variety of materials provided that they are suitable for use as a mallet or hammer. For example, the hammer head 10 may be made of hard rubber or plastic, such as is commonly used in rubber mallets, but is preferably made of metal, such as steel. A substantial proportion of the mass of the tool 1 is in the hammer head 10. The hammer head 10 may be between 0.5 and 2.5 kg and preferably about 1.5 kg.

The hammer head 10 is attached to the handle 20 by a bracket 11 comprising a base 12 mounted normal to a top end of the handle 20 and a pair of upstanding arms 13 extending normal to the base 12 and parallel to the longitudinal axis of the handle 20 to provide mounting means for the hammer head 10. The arms 13 include bores (not shown) through which the hammer head 10 extends. The base 12 is preferably welded to the top end of the handle 20. The bracket 11 may be integrally formed by casting in one piece or the base 12 and arms 13 may be welded together. Similarly, the hammer head 10 may be welded or brazed to the arms 13. In another arrangement, the hammer head 10, bracket 11 and handle 20 are all integrally formed from moulded plastic, the plastic being of a particularly heavy, hard and strong nature. The plastic in such an embodiment is preferably polypropylene containing suitable additives to obtain the aforementioned preferred characteristics.

The handle/body 20 is an elongate cylindrical tube and is preferably made from metal, still more preferably steel, and most preferably from forged steel. The top end of the handle 20 may include an end plate welded therein and the base 12 may be bolted or welded onto the end cap or the terminal ends of the wall of the cylinder of the handle 20, as the case may be.

The operating rod 30 includes peg engaging means such as a hook 31. The hook 31 may be simply formed by bending the operating rod 30. Preferably hook 31 would be forge formed and shaped for maximum toughness. Preferably hook 31 would also be shaped to facilitate engaging with the tent peg which may be embedded in the ground. For that reason, the end of hook 31 may taper to a point. The hook 31 may include retaining means 32 anchored at one end 33 to the operating rod 30, its free end 34 capable of resilient deflection whereby to receive or release the tent peg within the space 35 defined by the hook 31 and retaining means 32.

In another embodiment, the operating rod 30 is in the form of high tension flexible cable (not shown). However, a rigid operating rod 30 is preferred as any stretching in that part of the system of the tool 1 would diminish the ultimate shock load applied by the tool 1.

Figure 2:
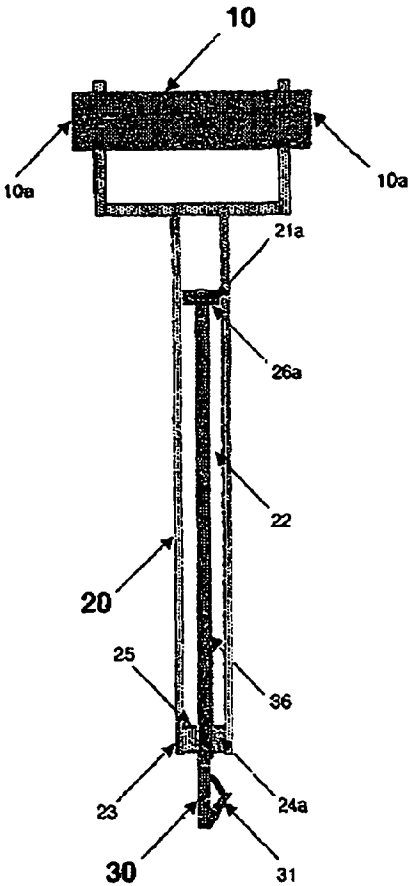
FIG. 2 is a sectional view of the embodiment shown in FIG. 1.

Turning to FIG. 2, the internal detail of the body/handle 20 and the operating rod 30, and other components of this particular embodiment is more clearly shown. The top end of the operating rod 30 includes a captured impact member 21*a* adapted to slide longitudinally within the internal space or bore 22 defined by the elongate tubular body 20. The captured impact member 21*a* may be in the form of a sliding collar 21*a* made of metal and either threadably attached to the end of the operating rod 30 or welded thereon. The sliding collar 21*a* is of a shallow cylindrical construction and its diameter corresponds closely to the internal surface diameter of the tubular body 20 whereby to permit low friction translation of the sliding collar 21*a* within the body 20, but a sufficiently tight fit to prevent significant lateral movement of the sliding collar 21*a* relative to the body 20. The lower end 23 of body 20 defines an opening through which the connecting portion from the impact member 21*a* to the peg engaging means 31, shown as shaft 36 of the operating rod 30, reciprocatingly moves. The aperture is defined in a strike area of the internal space of the body 20 by a fixed collar 24*a* welded or threadably engaged into the lower end 23. The fixed collar 24*a* may be made from material having a low friction coefficient, such as Teflon™ (PTFE) or, alternatively, and preferably, from metal. The fixed collar 24*a* still more preferably is made from hardened metal, such as forged steel. The fixed collar 24*a* optionally includes a hardened metal cap 25 which acts as the strike area providing a striking surface or as a strike plate adapted to absorb very little energy on impact by the underneath striking surface 26*a* of the impact member or sliding collar 21*a*. It can therefore be seen that the tool 1 applies conventional hammering (shock load) principles to drive in pegs (such as tent pegs used in camping activities) into the ground and also applies to a peg an impulsive withdrawing force when the striking surfaces 25, 26*a* impact with each other, thereby facilitating removal of a peg from the ground. The device will prove to be of great value to many people including caravan and tent campers who frequently have difficulty removing tent pegs from ground which is hard packed and/or of a heavy clay type. The tool will help reduce back injury risk.

The tool may be used to drive pegs into the ground. The device is used as a conventional mallet (or hammer) to strike the upper end of the peg and drive the peg into the ground in the normal way. To this end the hook portion 31 is releasably retained in association with the lower end 23 by a plastic moulding, a strap, loop, retaining clip or the like (not shown). Accordingly, the tool 1 is similar in appearance to a conventional hammer and may be used accordingly. However, the tool can also be used to easily remove a peg from the ground via the sliding hammer arrangement of the tool 1. The sliding collar 21*a*, being the upper most end of the operating rod is permanently constrained within the tubular body 20 by the fixed collar 24*a*.

Figure 4:
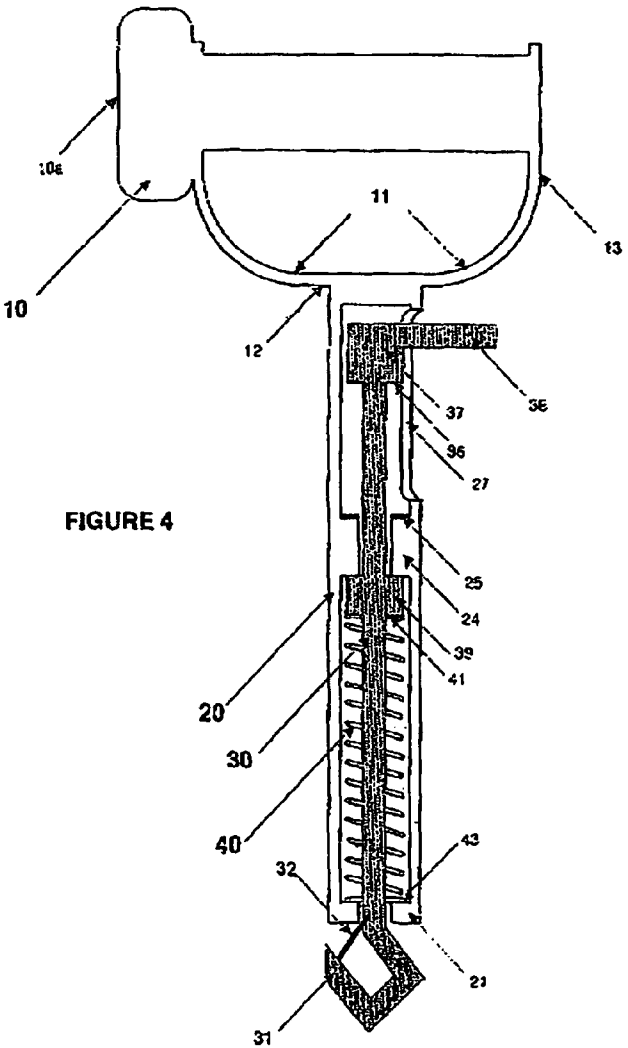
FIG. 4 is a sectional view of the embodiment shown in FIG. 3.

Referring specifically to FIGS. 3 and 4, body 20 partially encloses operating rod 30, generally secures operating rod 30 as part of tool 1 and provides for operating rod 30 to move reciprocatingly along the common axis of body 20. Fixed collar 24 is located within body 20 to restrict the downward travel of operating rod 30 relative to body 20.

In the embodiment shown in FIG. 3, the hammer head 10 is made of forged steel to ensure toughness. The striking face 10*a* of the hammer head 10 is heat treated for hardness.

Fixed collar 24 is formed as part of body 20 or strongly and rigidly fixed to body 20 by welding or brazing and/or fixed by screws or pins. Operating rod 30 is able to pass up and down through fixed collar 24 with minimal frictional resistance. Fixed collar 24 may be made from material having a low frictional resistance, such as Teflon™ (PTFE) or, alternatively and preferably from metal. The fixed collar 24 still more preferably is made from hardened metal, such as forged steel. The fixed collar 24 optionally includes a hardened metal cap 25 on its upper face which acts as a strike plate adapted to absorb very little energy on impact by the underneath surface 36 of the sliding collar 37. The fixed collar 24 may be fitted with a bush (not shown) providing low frictional resistance to the movement of operating rod 30 through fixed collar 24.

The lower fixed collar 21 is similar in most aspects to the fixed collar 24 except that the lower fixed collar may be of lighter construction and shorter than fixed collar 24. In an embodiment without a spring arrangement, there may be only one fixed collar of the size and style of fixed collar 24 which may be located where the lower fixed collar 21 is shown in FIG. 4.

In the case of a spring arrangement embodiment, the spring compressing lever 38 is able to be moved downward by virtue of a slot 27 in body 20. The slot 27 provides ample clearance to lever 38 to not restrict the up and down movement of lever 38 and thus operating rod 30.

The upper section of the operating rod 30 includes a captured portion 37 adapted to slide within the internal space 22 defined by the body 20. The captured portion 37 may be in the form of a sliding collar 37 made of metal and either formed as part of operating rod 30 or threadably attached to the end of the operating rod 30 or pinned or riveted or welded or brazed thereon. The sliding collar 37 is of shallow cylindrical form and its diameter corresponds closely to the internal diameter of the body 20 whereby to permit low friction translation of the sliding collar 37 within the body 20, but a sufficiently close fit to prevent significant lateral movement of the sliding collar 37 relative to the body 20.

Also part of operating rod 30, or attached to operating rod 30 by similar means to those which attach sliding collar 37 to operating rod 30, is spring compressing lever 38. FIG. 4 shows the connection of spring compressing lever 38 with operating rod 30 via the sliding collar 37 however the connection with operating rod 30 can be at any point on the length of operating rod 30 provided that the spring compressing lever 38 is able to move the operating rod 30 downwards and compress the spring 40 when the spring compressing lever 38 is moved downwards. In the embodiment illustrated, the spring compressing lever 38 is able to slide easily in slot 27 formed in body 20 by the appropriate removal of part of the wall of body 20.

Also part of operating rod 30, or attached to operating rod 30 by similar means to those that attach sliding collar 37 and spring compressing lever 38 to operating rod 30, is spring stop 39. Spring stop 39 is generally similar in cylindrical form to sliding collar 37 however spring stop 39 may be of lighter construction than sliding collar 37 and may be shorter in length.

The tool 1 may or may not include a spring arrangement within the body 20. Any spring arrangement is not essential for the functioning of tool 1. The main purpose of the spring arrangement is to securely contain the operating rod 30 within the body 20 whilst the tool 1 is not in use as a peg extraction tool. The spring arrangement may involve a tension spring or compression spring arrangement.

Any spring used for this purpose in the tool 1 should be of very light operating characteristic such that the effect of the spring does not significantly reduce the impact effect of the tool 1 during the peg extraction function. The spring should be only stiff enough to overcome the sliding frictional resistance that occurs between body 20 and operating rod 30 such that operating rod 20 is returned to a position within body 20 by the unaided action of the spring.

Any spring arrangement may or may not require a means to expose more of the operating rod 30 from the bottom of body 20 prior to using tool 1 as a peg extraction tool. Spring compressing lever 38 is used for this function in the embodiment illustrated at FIG. 4. Alternatively the device could be configured so that the operating rod 30 could be moved down relative to body 20 by pushing directly onto an upper extension (not shown) of the operating rod 30 that protruded above the tubular body 20 through a hole in the top of the tubular body 20 (not shown). A further alternative could include a flexible control cable arrangement (not shown) to move the operating rod 30 down relative to body 20.

A spring arrangement is illustrated in the embodiment of tool 1 illustrated at FIG. 4. The compression spring 40 is contained within the body 20 and secured between the spring stop 39 and the lower fixed collar 21. Downward movement of operating rod 30 is opposed by the compression of spring 40 between the lower surface 41 of spring stop 39 fixed to operating rod 30 and the upper surface 43 of lower fixed collar 21 fixed to body 20. A spring compression lever 38 is provided to manually expose more of the operating rod 30 and thus facilitate the engagement of the tent peg to be extracted (not shown) with hook 31.

As can be seen, the first embodiment is similar to that illustrated at FIG. 3, but without a spring arrangement and does not include the spring 40, the spring stop 39 or the lower fixed collar 21 which is replaced by a relocated fixed collar 24. The slot 27 and lever 38 are also not necessary in the first embodiment.

To use the tool 1 to remove a tent peg from the ground, the hook portion 31 is appropriately engaged with the accessible part of the tent peg via the simple bent rod hook (common to most tent pegs in current use) or via an otherwise formed hook on the tent peg or via an eye in the tent peg or via a loop attached to the tent peg or by any other means that ensures a firm connection between the peg and the operating rod 30.

It may be necessary to expose more of operating rod 30 from within body 20 prior to engaging hook 31 with the tent peg to be extracted. In the embodiment illustrated at FIG. 1, spring compressing lever 38 is moved down relative to body 20 to increasingly expose operating rod 30 and facilitate the connection to the tent peg to be extracted. In other configurations, it may be necessary to release operating rod 30 from any retaining arrangement, trap, loop, or retaining clip that has previously secured operating rod 30 within body 20.

The hammer head/handle 10 is grasped by an operator and moved upwards and away from the peg in a line that roughly follows the line along which the peg was driven into the ground. As the body 20 of the tool 1 is raised, the operating rod 30 will slide through the upper fixed collar 24 and the lower fixed collar 21 until lower face 36 of the sliding collar 37 makes contact with the upper face of the fixed collar 24 or the strike plate 25. Continued pulling (removing) force applied by the operator via the hammer head 10 will now transmit to the peg.

To apply a hammering force (shock load) to the peg, the operator moves the hammer head 10 a distance towards the peg (the actual distance is not critical—even a very short distance will normally suffice). The operator then jerks the hammer head 10 away from the peg roughly along the line of the tent peg shaft. The speed of that movement combines with the combined mass of the hammer 10 and body 20 to create substantial momentum which is transmitted to peg as a shock load via the operating rod 30 when the sliding collar 37 contacts the fixed collar 24 or the strike face 25.

A notable feature of the tool 1 is that almost all the mass of the tool 1 contributes to the operating momentum. Only the relatively small mass of the operating rod 30 is not utilised. The hammering action can be repeated, if necessary, to break the ground's grip on the tent peg. In each reciprocating movement, the continuous engagement of the operating rod with the peg is assured by means of the simple capturing clip 32. Additionally or alternatively, the action of the spring 40 serves to maintain contact between the operating rod 30 and the tent peg on the down stroke provided that the reciprocating movements are short enough to maintain some compressive force on the spring 40. Once the ground's grip is overcome, a subsequent steady pull will normally remove the peg from the ground quite easily. Even in soft ground the tool 1 has benefit because it reduces the amount of bending required to extract a tent peg from the ground.

The tool 1 may also be used to drive tent pegs into the ground. The tool is grasped by the handle 20 and the device used as a conventional mallet (or hammer) to drive the tent peg (not shown) in the ground in the normal way by striking the upper end of the tent peg with the face of the hammer head 10. Operating rod 30 is redundant during this function and is releasably retained within the body 20 by a strap, loop or retaining clip, etc. (all not shown) located adjacent to or forming part of the handle 20 or attached to or forming part of a plastic or rubber hand grip (now shown) that may be fitted over the handle 20 for user comfort. In the embodiment illustrated at FIGS. 3 and 4, the retaining of the operating rod 30 within the body 20 is achieved by the spring arrangement (previously described).

It can be seen that the operating rod 30 and body 20 are coaxially aligned and this is desirable to impart maximum force to the peg. Of course, non-coaxial alignment in use may occur where a flexible operating cable (not shown) is used, or where the operating rod 30 and body 20 are aligned for adjacent, parallel, but non-coaxial movement relative to each other. Notwithstanding this, it will be appreciated that the preferred arrangement is to have the operating rod 30 and body 20 coaxially aligned.

Figure 5:
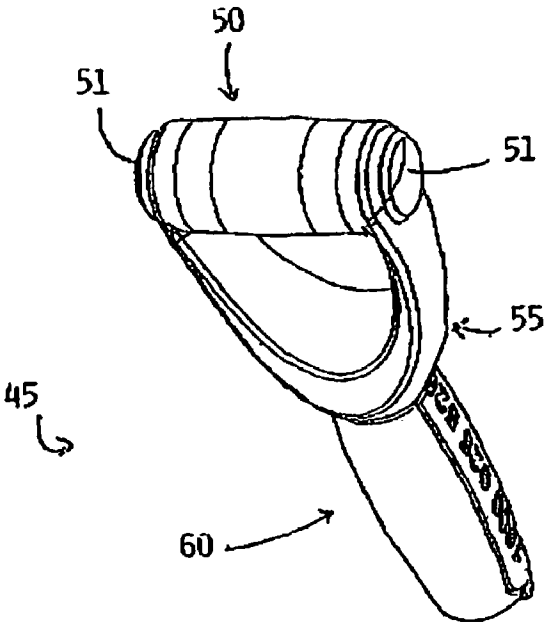
FIG. 5 is a front perspective view of a handle forming a mallet according to a third embodiment of the invention.
Figure 12:
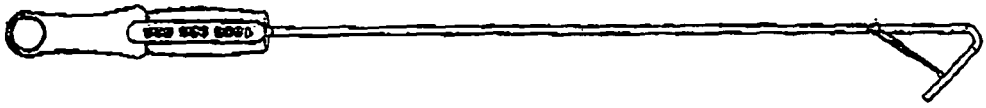
FIG. 12 is a side view from the right hand side of the fourth embodiment.
Figure 11:
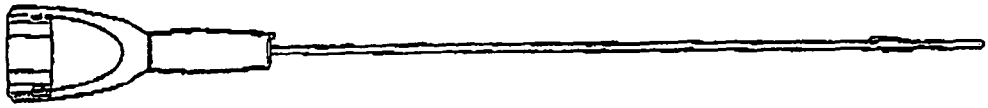
FIG. 11 is a front view of the fourth embodiment.
Figure 10:
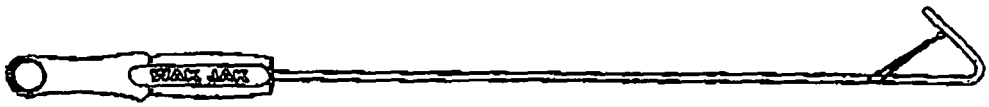
FIG. 10 is a side view from the left hand side of the fourth embodiment.
Figure 9:
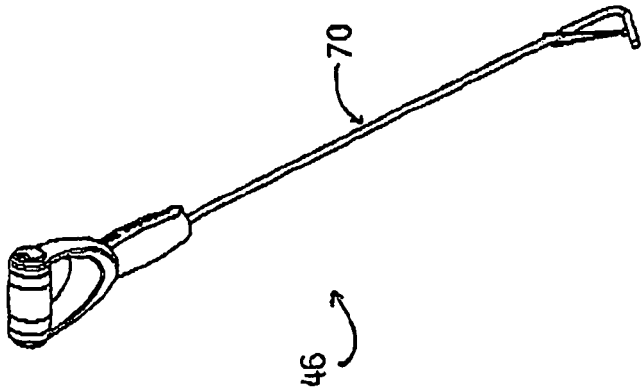
FIG. 9 is a front perspective view of a fourth embodiment of the invention.

Referring to the third embodiment in FIGS. 5 through to 8, there is shown a mallet 45 comprising a hammer head handle 50, a 2-armed bridge 55 in the manner of a typical spade handle and a body 60. The mallet 45 comprises a central core metal frame structure separately moulded or cast from, for example, steel (preferably stainless) and covered with a pliable plastic material by injection moulding to provide a pleasant, tactile surface. The ends 51 of the hammer head 50 are not covered by the injection moulding process, but are left exposed for use as the impact surfaces for the mallet. The external cigar-shaped surface of the body 60 serves as a handle to be grasped by the user. The rigid metal core frame reduces the vibration of the tool which might otherwise be observed through the bridge 55 whereby the mallet 45 is effective to drive pegs into ground, even hard baked ground, by the user grasping the body 60 and hitting the peg head with one of the impact surfaces 51.

Figure 16:
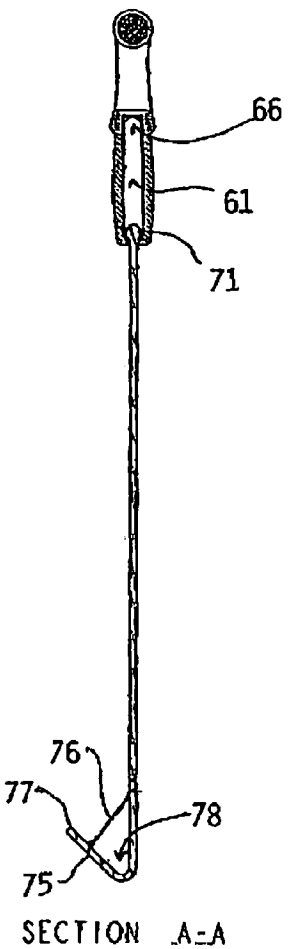
FIG. 16 is a side sectional view of the fourth embodiment.
Figure 13:
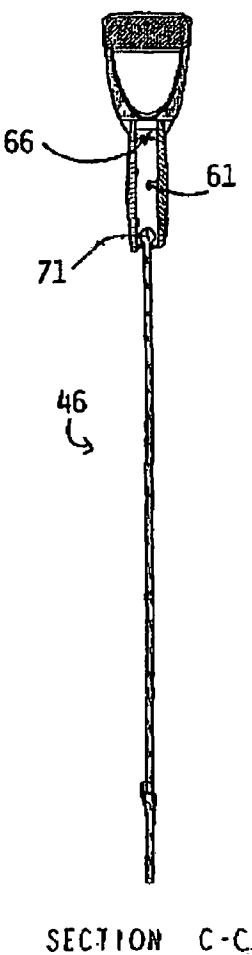
FIG. 13 is a rear sectional view of the fourth embodiment.

With reference to FIGS. 9 to 16, there is shown a peg extraction tool 46, including a peg engaging member 70. The fourth embodiment utilises the mallet 45 of the third embodiment to which the peg engaging member 70 is added. As seen in FIG. 13 and 16, the peg engaging member 70 includes a captured portion 71 trapped within a cylindrical bore 61 defined by the body 60. The substantially cylindrical bore is non-circular in cross-section and is therefore not a true cylindrical bore, but is asymmetrical whereby to prevent the axial rotation of the captured portion 71 about the longitudinal axis 72 of the elongate rod 73 of the peg engaging member 70 shown in FIG. 14.

The peg engaging member further includes a peg engaging means 74 comprising a hook 75 and a retaining means 76 in the form of a deflectable spring steel.

Figure 8:
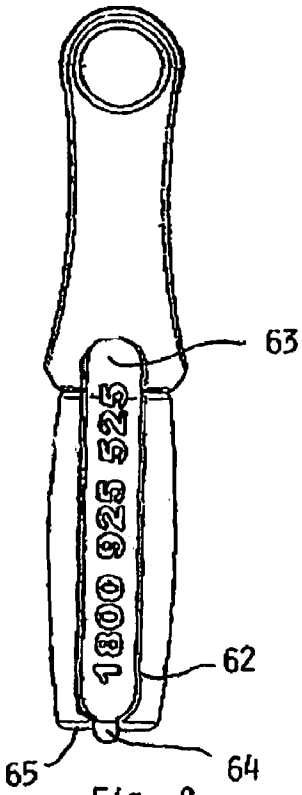
FIG. 8 is a side view from the right hand side of the third embodiment.
Figure 7:
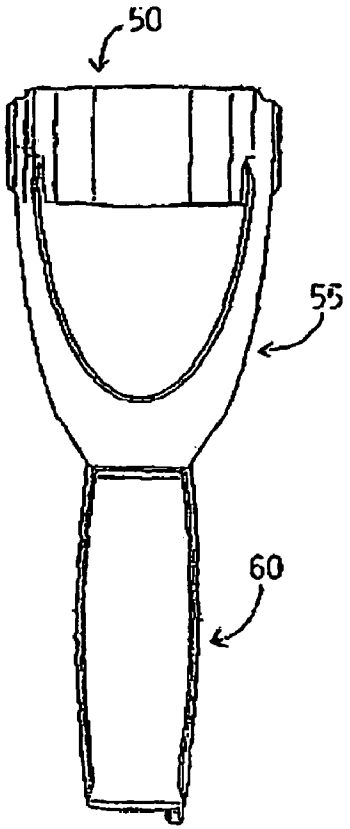
FIG. 7 is a front view of the third embodiment.
Figure 6:
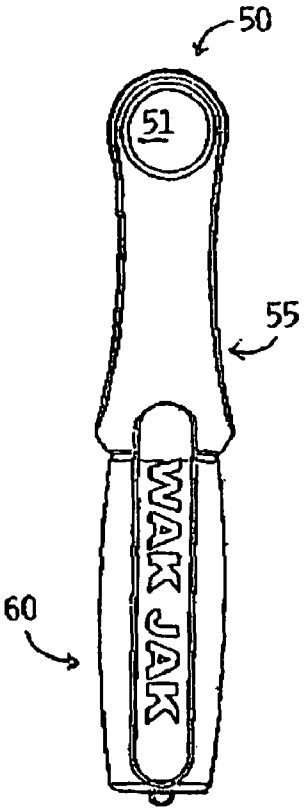
FIG. 6 is a side view from the left hand side of the third embodiment.
Figure 15:
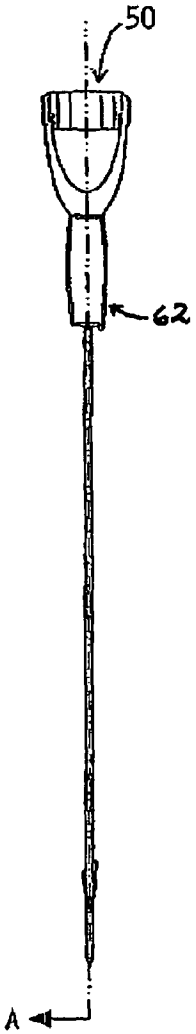
FIG. 15 is a front view of the fourth embodiment.
Figure 14:
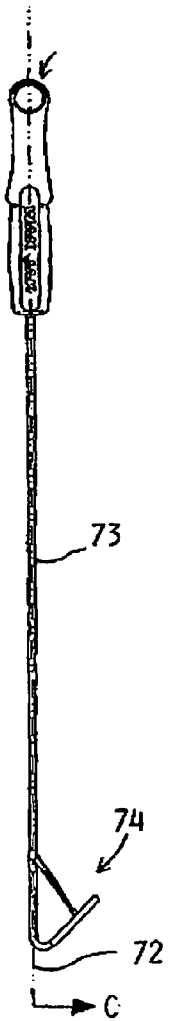
FIG. 14 is a side view from the left hand side of the fourth embodiment.

The body 60 further includes a closure 62 shown in FIG. 8 and FIG. 15 which is hinged to the lower portion of the bridge 55 and inset therein at location 63. At the closure's 62 free end there is provided a tab 64 for easy manipulation by an operator using her fingers. The lower portion of the closure 62 completes the loop of an end cap 65 integrally formed in the bottom end of the body 60. The end cap 65 operates as a strike plate for the captured portion 71. The end cap 65 forms, when the closure 62 is in the closed position, and aperture through which the rod 73 extends. The aperture is of a circular cross-section corresponding to the cross-section of the rod 73 so that the rod 73 is freely capable of sliding through the aperture. The captured portion 71 is too large to pass through the aperture so that, when the closure 62 is closed, the captured portion 71 is trapped in the bore 61 and able to reciprocally linearly travel up and down the bore 61.

To remove a peg embedded in the ground, the user grasps the hammer handle 50 and manipulates the hook 75 so that its end 77 is pushed through the hook of the peg so that the hook of the peg passes the retaining means 76 by deflecting same whereby the peg hook comes to rest in the crook 78 of the peg engaging means 74. During this operation it is important that there be minimal axial rotation of the hook 75 to enable the hook 75 to be negotiated into engagement with the peg hook. The user then gently pushes the hammer handle 50 towards the hook 75 so that the captured portion 71 travels through the bore 61 whereby the captured portion 71 comes to rest against the upper end 66 of the bore 61. The user then rapidly jerks the hammer handle 50 away from the hook 75 so that the captured portion 71 quickly travels (relatively) through the bore 61 to impact on the end cap 65 with a significant strike load which translates to the hook 75 and the peg hook where by to dislodge same from the ground. Even in heavily compacted, very hard ground, the peg extraction tool 46 of the fourth embodiment is typically effective to remove the peg from the ground with no more than two or three jerks of the hammer handle 50.

Figure 17:
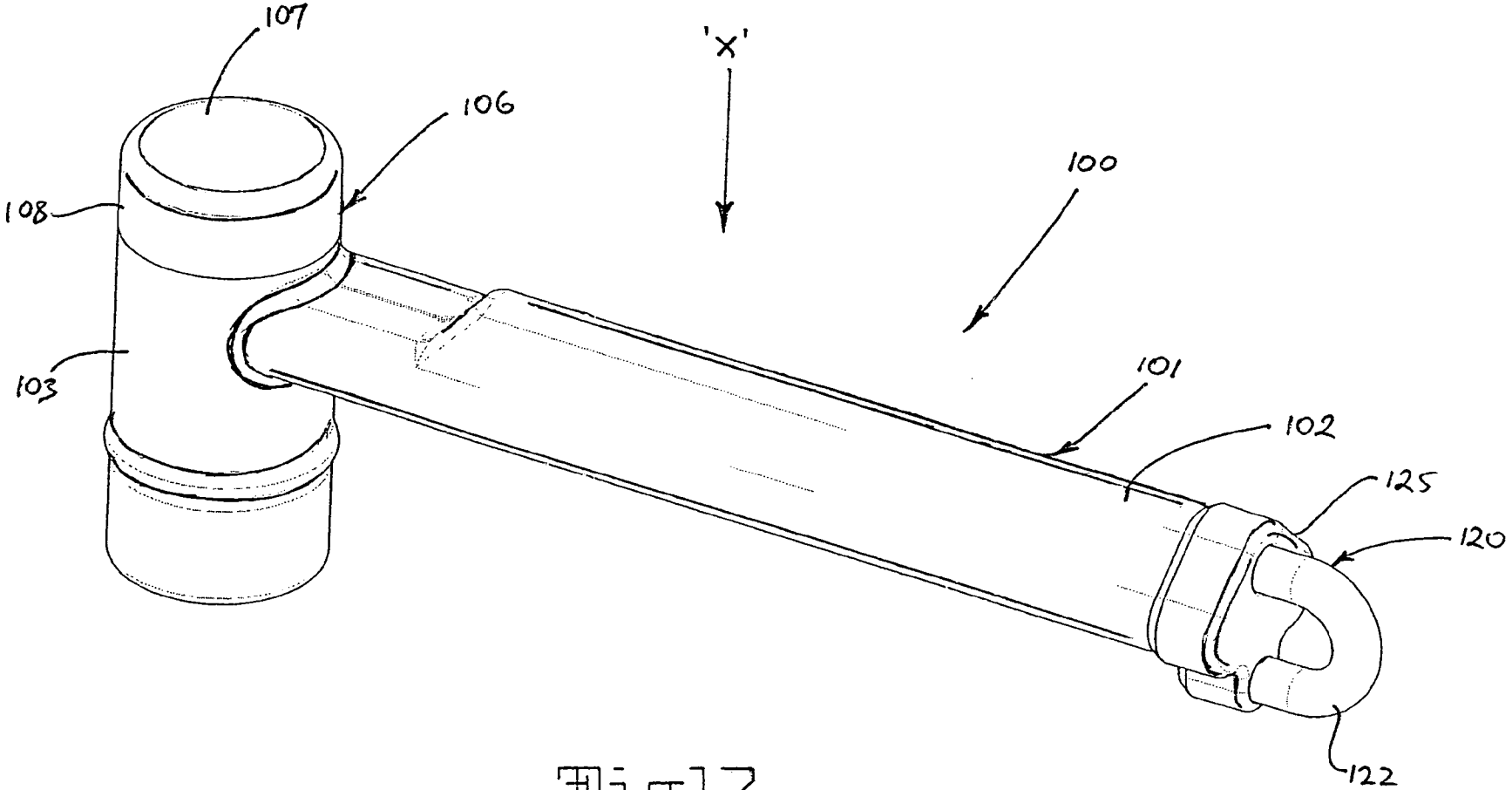
FIG. 17 is a perspective view of a fifth embodiment of the invention.
Figure 18:
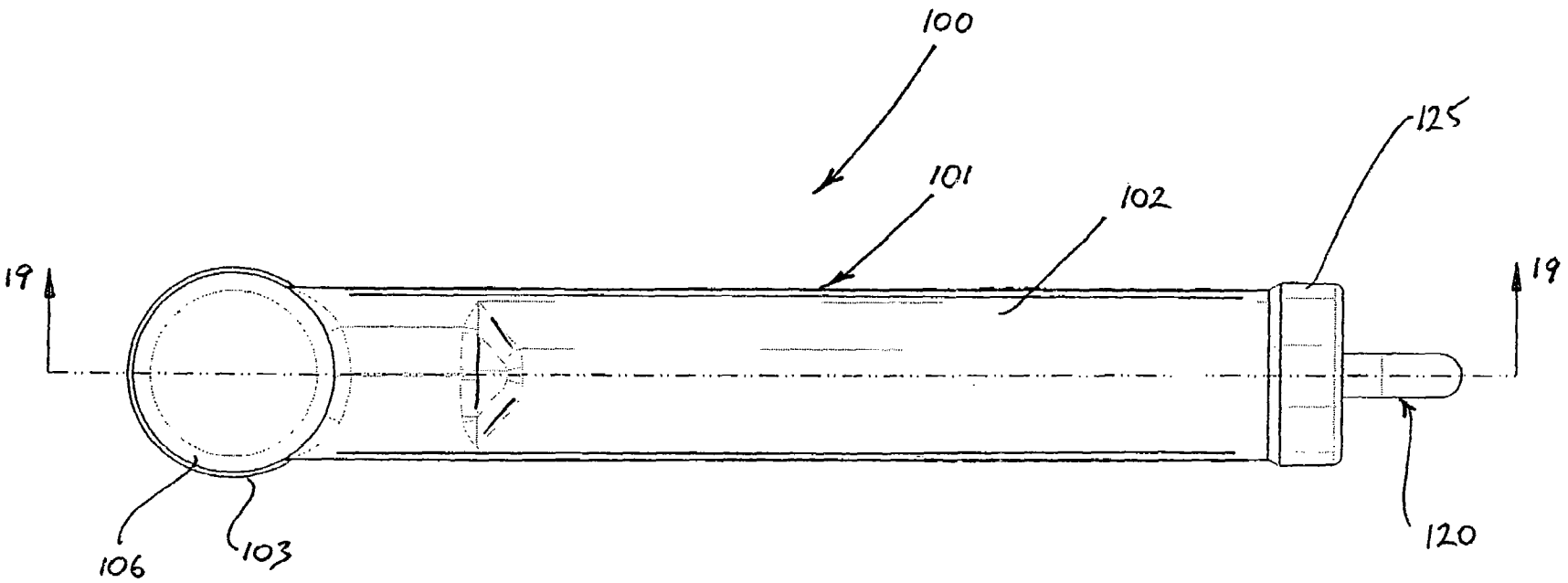
FIG. 18 is a view of the fifth embodiment as seen looking in the direction of arrow "X" in FIG. 17.
Figure 19:
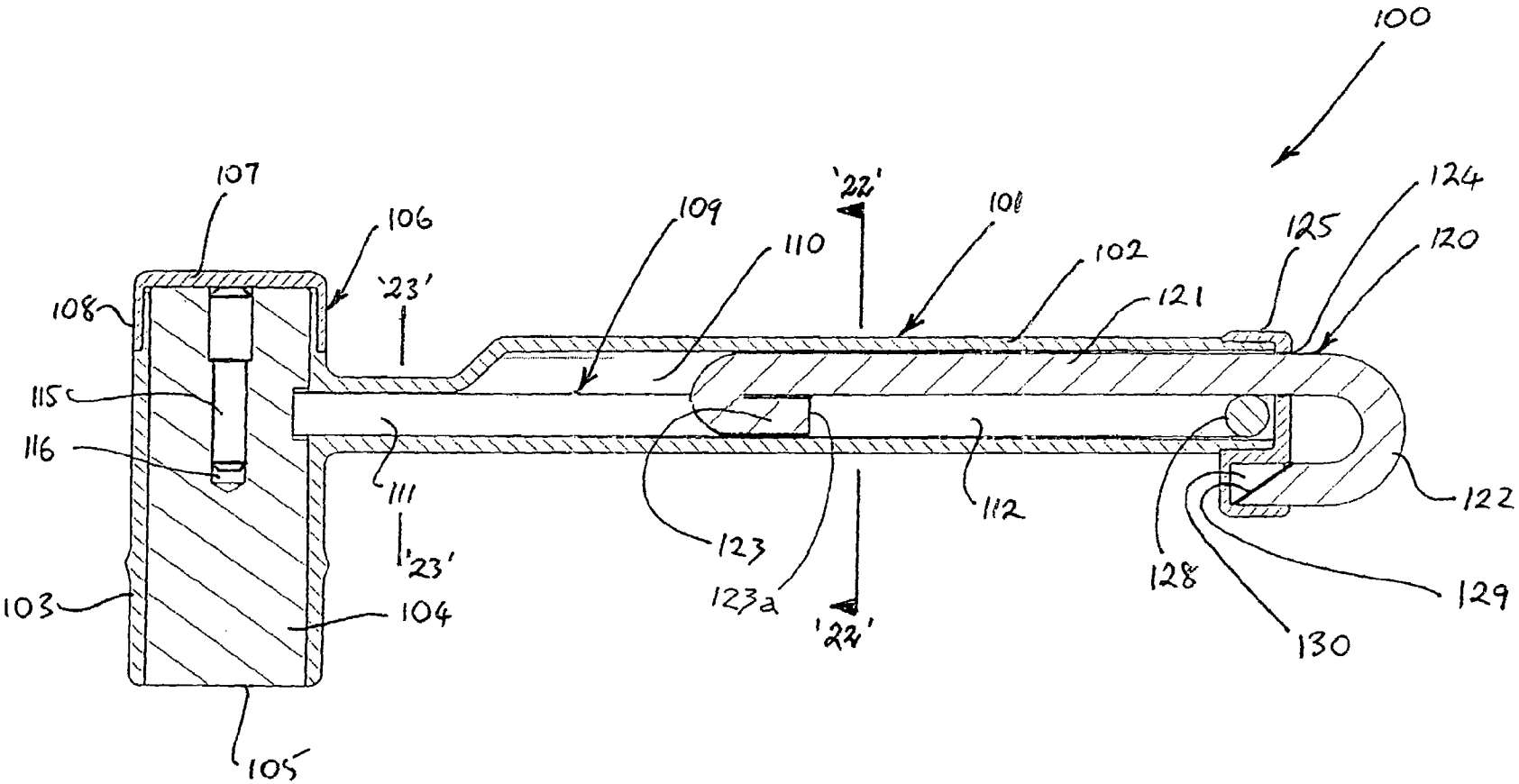
FIG. 19 is a cross-sectional view of the fifth embodiment the cross-section being taken at station "19-19" in FIG. 18.
Figure 20:
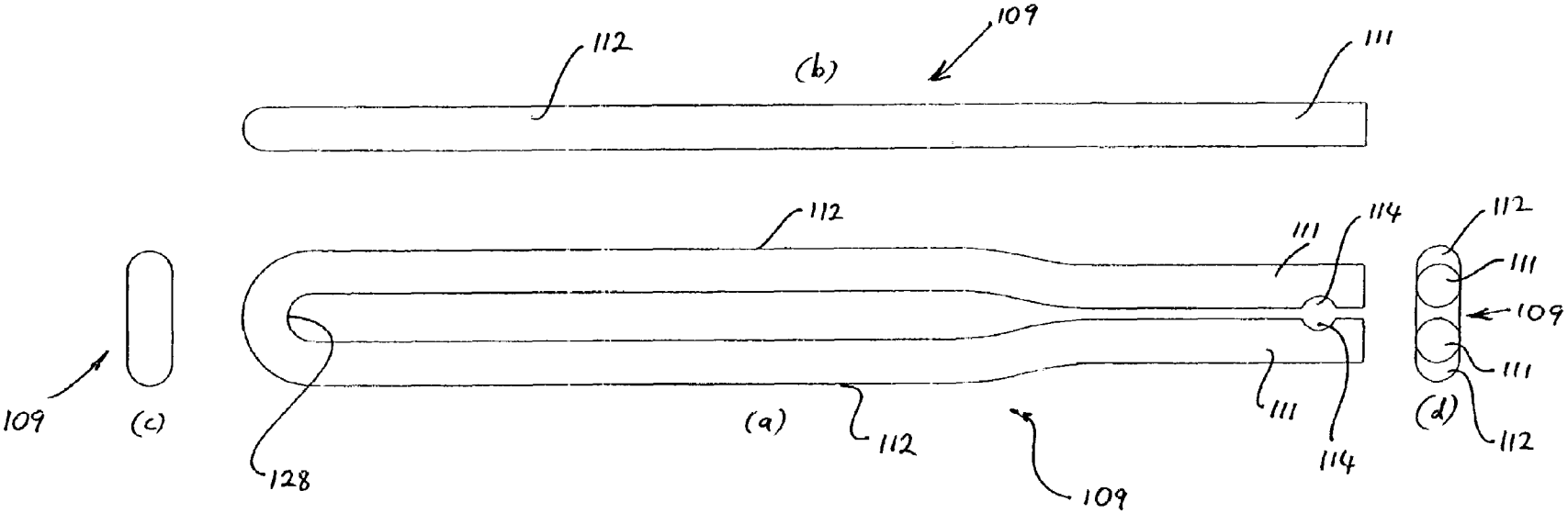
FIG. 20 comprises side, plan and two end elevations (marked (a), (b), (c) and (d) respectively) of a guide component of the fifth embodiment.
Figure 12:
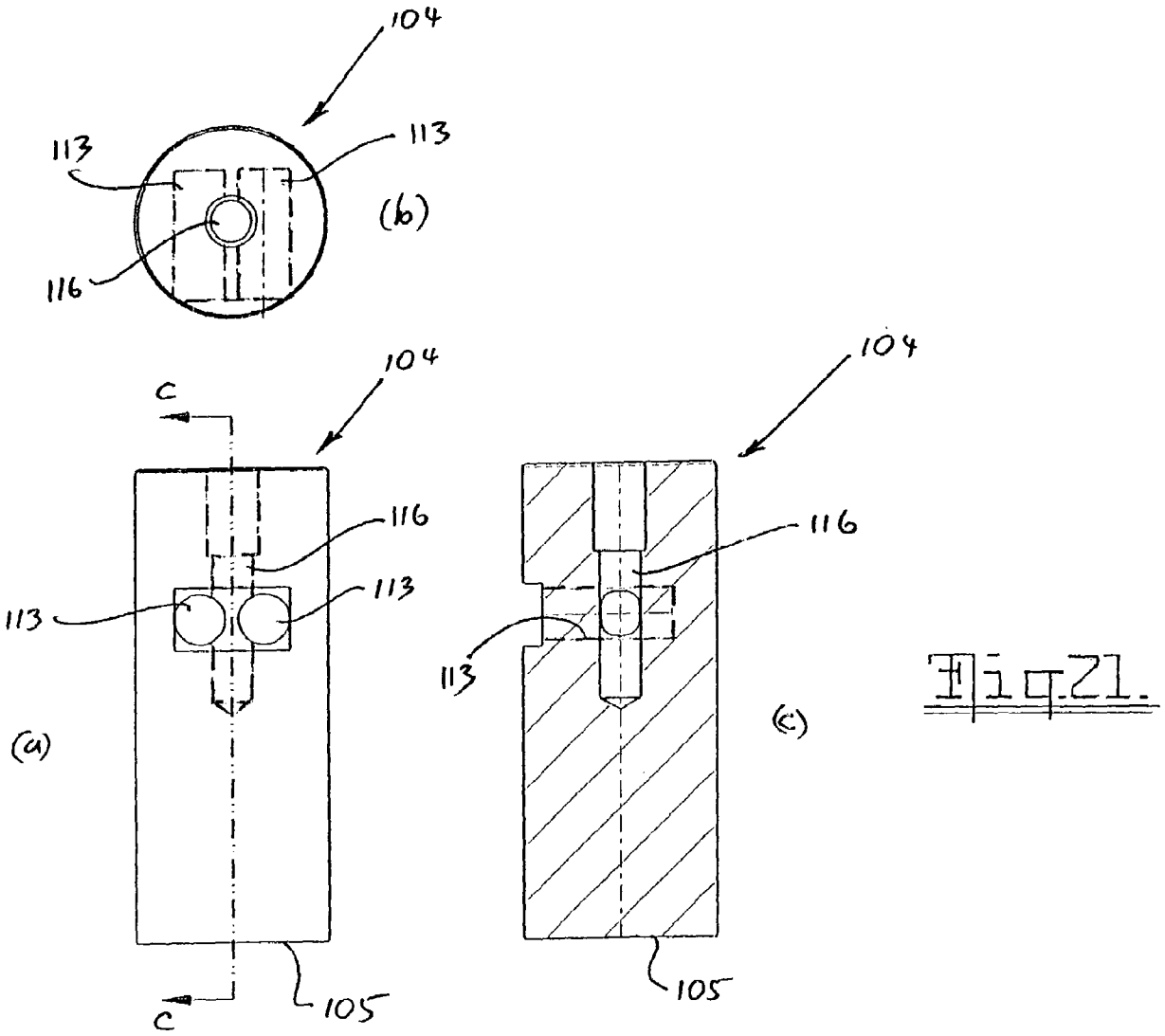

FIGS. 17 to 19 show a peg driving mallet and extraction tool 100 that is a fifth embodiment of the invention. As shown in FIG. 17, tool 100 can closely approach the appearance of a conventional mallet. Tool 100 comprises a first elongate peg-engaging component 120 and a second component 101 slidable along component 120. The component 101 has a handle portion 102 and a head portion 103, secured to and preferably integrally formed with handle portion 102. Although other materials may be used, and are not intended to be precluded, body 101 is preferably formed by injection moulding in a suitable plastics material or synthetic rubber-like material. A massive part comprised by a peg driving head 104 is held captive (by means described below) within the head portion 103 of body 101. Head portion 103 defines an external casing which fits closely around head 104 so that in use there can be substantially no relative movement between portion 103 and head 104. Head 104 is of generally cylindrical shape, and is preferably formed from a suitably tough and heavy metal (for non-exclusive example a steel forging). Tool 100 is usable as a mallet to drive pegs into the ground. The user grasping handle portion 101 for this purpose. Head 104 has an end face 105 that is not covered by head portion 103 and that in such use of tool 100 impacts pegs to be driven.

A cap 106 covers the end of head 104 remote from surface 105. Cap 106 is preferably (but not essentially) formed by injection moulding in a suitable plastics material and has a disc-like end 107 and a peripheral wall 108 that extends axially from end 107. Cap 106 fits tightly enough on head portion 103 to be retained thereon by friction, although a suitable adhesive or fastener (not shown) could alternatively be used.

An elongate tension member in the form of a generally U-shaped guide 109 is snugly received in internal space 110 of handle portion 102 and secured to the massive head 104. Guide 109 is preferably (but not essentially) formed from a metal (for example steel). Conveniently, guide 109 can be formed from round rod stock. End portions 111 of arms 112 of guide 109 are received in holes 113 of massive head 104. Recesses 114 are provided on end portions 111 so that a retainer component shown as a round pin 115 can be received between end portions 111 when pin 115 is driven into an axial opening or hole 116 in head 104. Hole 116 intersects holes 113, as best seen in FIG. 21. Pin 115, recesses 114, holes 113 and hole 116 and end portions 111 are so dimensioned and positioned that pin 115 retains end portions 111 tightly in place within holes 113 when force-fitted into position between portions 111. Pin 115 may for example be forced into this position by a hydraulic press during assembly of tool 100.

Figure 22:
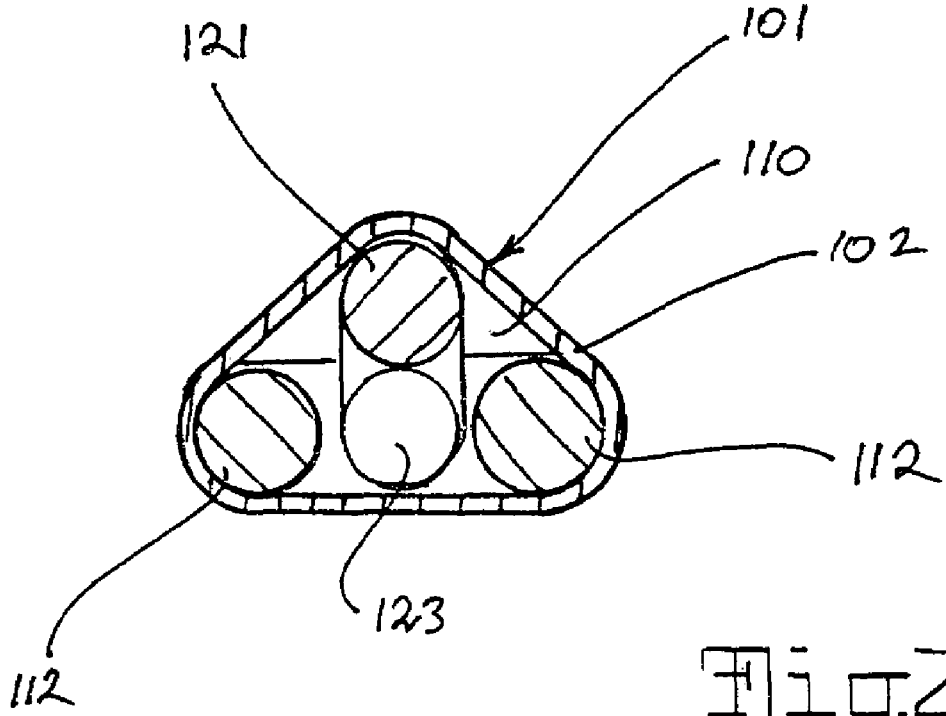
FIG. 22 is a cross-section view taken at station "22-22" of FIG. 19, omitting details beyond station "23-23"

An elongate peg-engaging member 120 is provided, comprising a rod 121 formed at one end into a hook 122 adapted for hooking onto a peg in the ground, and at the other into a laterally extending formation 123 formed by bending the rod back upon itself. Rod 121 is partially received in internal space 110 of handle portion 102 of body 101, and extends through an opening 124 in an end cap 125 mounted on handle portion 102 at the end thereof opposite head portion 103. Member 120 can slide freely lengthwise within handle portion 102, being constrained to move only lengthwise by the sliding clearance of rod 121 in opening 124, by the sliding fit of formation 123 between arms 112, and by sliding fit of member 120 against inner surface 126 of handle portion 102. This is best seen by examination of FIG. 22, which shows arms 112, snugly received in internal corners of handle portion 102 which is generally triangular-sectioned and rod 121 slidingly received in a third corner. The positioning of formation 123 between arms 112 also substantially prevents rotation of member 120 in handle portion 102.

Movement of member 120 is limited in one direction (to the right as seen in FIG. 19) by contact between the end face 123*a* of formation 123 (which constitutes the striking surface of the impact member) and a part 128 of guide 109 that joins and extends between arms 112 (which constitutes the strike area having the striking surface). In the opposite direction, movement is limited by entry of hook end 129 into a cooperating recess 130 in end cap 125.

Hook end 129 is preferably bevelled as shown in FIG. 19 to make it easier to hook it under pegs driven comparatively deeply into the ground. It is preferred also that the hook end 129 is receivable and frictionally retainable in the co-operating recess 130 at the end of the handle portion 102 so as to hold the rod 121 in its position of maximum engagement within the handle portion 103. Hook end 129 fits tightly enough into recess 130 to be held there when tool 100 is in use as a mallet or stored.

When tool 100 is to be used as a mallet for hammering pegs into the ground, member 120 is preferably positioned as shown in FIG. 19, with hook end 129 received in recess 130 of end cap 125. Tool 100 then looks like and acts like a conventional mallet. When it is required to remove pegs, member 120 is pulled out (i.e. to the right as seen in FIG. 19) so as to release hook end 129 from recess 130. Hook 122 is then hooked onto the peg (not shown) and handle portion 103 aligned at least approximately with the length of the peg. Then, by briskly moving the body 101 away from the peg, an impact force tending to withdraw the peg is applied to the peg when formation 123 impacts guide part 128. By reciprocatingly moving body 101 towards and away from the peg, repeated impacts can be applied to the peg until it is freed.

Figure 23:
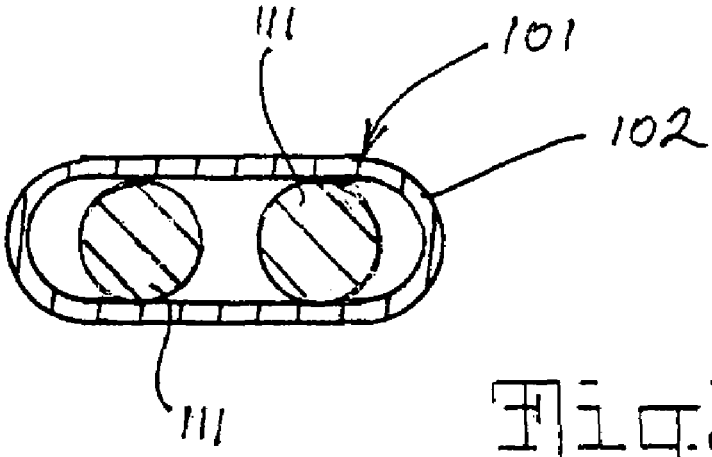
FIG. 23 is a cross-sectional view taken at station "23-23" of FIG. 19.

Handle portion 102 has, as an option, a section 102*a* that is of modified cross-sectional shape (compare FIGS. 22 and 23) to provide for convenient gripping by a user when extracting pegs.

Apart from being robust and difficult to tamper with once assembled, it will be noted that tool 100 is very easy to assemble from its small number of parts. Once the various components are formed, the steps required are to:

(a) position head 104 in head portion 103 of body 101;
(b) position cap 125 and then guide 109 respectively on and in relation to component 120;
(c) enter guide 109 into handle portion 102 and into head 104;
(d) drive pin 115 into hole 116;
(e) apply cap 106 to handle portion 103.

Although the particularly described and illustrated embodiments show the hammer head at the end of the handle providing the internal space for the sliding impact member of the peg puller, it will be appreciated that the tubular body and internally sliding impact member could be interchanged. This can be visualised easily in relation to the construction of FIG. 19 in which the massive hammer head 103, 104 could be located and mounted on the end of rod 121 beyond the cap 125, and the peg engaging means or hook 122 could be mounted by the ends 111 of the tension member 109.

The invention as described has several notable features including but not limited to the following:

(1) This single tool competently performs both the driving in of tent pegs function and the extracting of tent pegs function. In that respect, it will be readily welcomed by outdoor campers who strive to simplify their leisure.

(2) The tool will be readily received by outdoor campers who often have difficulty extracting tent pegs. The tool is likely to reduce the incidence of back injury that can occur during the process of extracting severely bound tent pegs in heavy ground. In the extraction of tent pegs function, this tool is likely to be superior to other tools designed for that purpose because it so efficiently uses the slider hammer principle. The tool utilises almost all the mass of the tool to create the momentum that determines the efficacy of this type of device.

(3) Importantly, the invention provides a tool which is extremely safe to operate. The hazardous characteristic of slide hammer function is that such devices must rely on a heavy hard object meeting another hard object at speed to create the desired shock load. The dramatic meeting of those hard objects creates an opportunity for personal injury. In the case of the tool which is the subject of this invention, the coming together of the two objects occurs inaccessibly, and thus safely, within the body of the tool.

Orientational terms such as top, bottom, upper and lower are to be interpreted as relational and unless explicitly stated otherwise are based on the premise that the tool will usually be considered with the handle 10 or 50 or head portion 103 (as the case may be) uppermost when removing pegs.

When used in this specification and claims, the terms "comprises" and "comprising" and variations thereof mean that the specified features, steps or integers are included. The terms are not to be interpreted to preclude the possible presence of other features, steps or components.

It is to be understood that various alterations, modifications and/or additions may be made to the features of the possible and preferred embodiment(s) of the invention as herein described without departing from the spirit and scope of the invention.

The invention claimed is:

1. A tool for manipulation of a peg in a substrate, said tool comprising:

an elongate first component having at an end thereof means for engaging a peg in a substrate and applying a withdrawing force thereto;

a second component slidable along said first component from a first position to a second position where opposing striking surfaces of the first and second components impact with each other so that an impulsive said withdrawing force is transmitted by the first component to the peg, wherein said second component comprises a hammer head portion adapted for hammering pegs into a substrate, and further comprises an elongate handle portion adapted to be gripped by a user when hammering pegs into a substrate using said second component as a hammer, wherein the handle portion has an internal space and wherein a portion of said first component having said striking surface of the first component is received in the internal space of the handle portion and slideable therein in a longitudinal direction of said handle portion, wherein said hammer head portion comprises a massive part; wherein an elongate tension member is secured to said massive part and is received in said internal space of said handle portion; and wherein said striking surface of said second component is comprised in the tension member;

wherein:

(a) said tension member comprises two elongate arms that:

i. are secured to the massive part;

ii. are transversely spaced apart in said internal space and are connected to each other by joining means at an end of the tension member remote from the massive part, and (b) said striking surface of the second component is comprised in the joining means; and wherein said first component has a formation which comprises said striking surface of said first component and which is slidingly received between said arms.

2. A tool according to claim 1 wherein within said massive part said elongate arms are urged apart from each other and against internal surfaces of the massive part by a retainer component received in an opening in said massive part and between said arms so that said arms are tightly secured within said massive part.

3. A tool according to claim 2 wherein said retainer component comprises a pin force-fitted in said opening sin said massive part.

4. A tool according to claim 1 wherein said internal space of said handle portion is defined by an external casing of said handle portion.

5. A tool according to claim 4 wherein said massive part of said hammer head portion is close fittingly and at least partially enclosed within an external casing of said hammer head portion and wherein said hammer head portion and handle portion external casing are integrally formed with each other.

6. A tool according to claim 4 wherein said external casing is formed of a plastics or synthetic rubber-like material.

7. A tool according to claim 1 wherein a part of said first component within said handle portion comprises a rod having an end which is bent back upon itself to form said formation that comprise said striking surface of said first component.

8. A tool for manipulation of a peg in a substrate, said tool comprising:

a body having an internal space, and a peg puller which includes a peg engaging means for operative engagement with a peg in a substrate and an impact member located within and relatively movable within the internal space in the body, the body further including a strike area located within the internal space and located so that the impact member strikes against the strike area at one limit of movement thereof inside the internal space, the peg puller further including a connecting portion extending from the impact member to the peg engaging means so that when the impact member strikes against the strike area a shock load is transferred through the connecting portion to the peg engaging means to thereby apply a pulling force to the peg when engaged by the peg engaging means wherein the body comprises a massive part, a tubular body portion having an elongated bore therein which defines said internal space, an elongate tension member secured to said massive part and being received in said bore, said strike area being provided by the tension member spaced from said massive part; and wherein said tension member comprises two elongate arms that are secured to the massive part and which extend along and are spaced apart within said bore and which are connected to each other by a joining means at the end of the tension member remote from the massive part, and wherein said strike area is comprised by the joining means.

9. A tool according to claim 8 wherein the impact member is captured inside said internal space and is movable linearly within said internal space relatively towards and away from the strike area.

10. A tool according to claim 9 wherein the body comprises an elongated tube and the internal space comprises an elongated internal bore of the tube, the impact member being comprised by an enlarged head linearly movable within the tubular bore and the strike area being located at one end of the tubular bore.

11. A tool according to claim 10 wherein the strike area has an opening through which the connecting portion of the peg puller extends from the impact member which is captive inside the bore of the tube to the peg engaging means.

12. A tool as claimed in claim 8 wherein said impact member is slidingly received within said bore between said elongate arms of the tension member.

13. A tool as claimed in claim 8 wherein said connecting portion of the peg puller comprises an elongate rod and wherein said impact member comprises an end portion of the elongate rod which is bent back upon itself so as to be located between said elongate arms of the tension member and to be slidingly movable longitudinally along the elongate arms, whereby at one limit of travel of the impact member, the bent end portion of the connecting rod comprising the impact member strikes against the strike area comprised by the joining means between the two elongate arms of the tension member.

14. A tool for manipulating a peg in a substrate, said tool comprising:

a body having a strike area, and a peg puller comprising a peg engaging means for operative coupling to a peg in a substrate, an impact member movable linearly relative to the body so as to selectively move the impact member away from and towards and into contact with the strike area of the body so that the impact member strikes against the strike area of the body at one limit of movement thereof, and a connecting portion extending from the impact member to the peg engaging means so that when the impact member strikes against the strike area of the body, a shock load applies a pulling force through the connecting portion to the peg engaging means and thence to the peg in the substrate, wherein the tool further includes an internal space provided by either the body or the peg puller, and wherein both the impact member of the peg puller and the strike area of the body are located internally within the internal space with one of said impact member and said strike area being provided by an internal formation of the internal space and the other of said impact member and said strike area being provided by a captured formation relatively moveable within the internal space, and wherein the body comprises a massive part, a tubular body portion having an elongated bore therein which defines said internal space, an elongate tension member secured to said massive part and being received in said bore said strike area being provided by the tension member spaced from said massive part;

wherein said tension member comprises two elongate arms that are secured to the massive part and which extend along and are spaced apart within said bore and which are connected to each other by a joining means at the end of the tension member remote from the massive part, and wherein said strike area is comprised by the joining means.

15. A tool as claimed in claim 14 wherein said impact member is slidingly received within said bore between said elongate arms of the tension member.

16. A tool as claimed in claim 15 wherein said connecting portion of the peg puller comprises an elongate rod and wherein said impact member comprises an end portion of the elongate rod which is bent back upon itself so as to be located between said elongate arms of the tension member and to be slidingly movable longitudinally along the elongate arms, whereby at one limit of travel of the impact member, the bent end portion of the connecting rod comprising the impact member strikes against the strike area comprised by the joining means between the two elongate arms of the tension member.

* * * * *